US009888531B2

(12) United States Patent
Imm et al.

(10) Patent No.: US 9,888,531 B2
(45) Date of Patent: Feb. 6, 2018

(54) OVER-THE-RANGE MICROWAVE OVEN AND METHOD OF USING THE SAME

(71) Applicant: Dongbu Daewoo Electronics Corporation, Seoul (KR)

(72) Inventors: Jun Hyuk Imm, Seoul (KR); Jong Jin Lee, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 275 days.

(21) Appl. No.: 14/597,931

(22) Filed: Jan. 15, 2015

(65) Prior Publication Data

US 2016/0165672 A1 Jun. 9, 2016

(30) Foreign Application Priority Data

Dec. 5, 2014 (KR) ..... 10-2014-0174472

(51) Int. Cl.
*H05B 6/80* (2006.01)
*H05B 6/64* (2006.01)
*F24C 7/02* (2006.01)

(52) U.S. Cl.
CPC ..... *H05B 6/642* (2013.01); *H05B 6/6423* (2013.01)

(58) Field of Classification Search
CPC ..... H05B 6/6423; H05B 6/642
USPC ..... 219/756, 757, 400, 393, 681, 685, 702, 219/718; 126/21 A, 21 R, 39 R, 273 A, 126/299 D, 299 R, 198; 99/451
See application file for complete search history.

(56) References Cited

U.S. PATENT DOCUMENTS 6,433,324 B1 * 8/2002 Kim ..... H05B 6/6429 126/21 A
2002/0084267 A1 * 7/2002 Kim ..... H05B 6/6423 219/757
2008/0156794 A1 7/2008 Song et al.

FOREIGN PATENT DOCUMENTS

| | | | |
|---|---|---|---|
| CN | 1517592 A | | 8/2004 |
| EP | 1439740 A2 | | 7/2004 |
| JP | S61165525 | | 7/1986 |
| KR | 20-0189004 | | 7/2000 |
| KR | 20040064138 | | 7/2004 |
| KR | 10-2005-0056724 | | 6/2005 |
| KR | 10-0807384 | | 8/2008 |
| KR | 10-2013-0036415 A | | 4/2013 |
| KR | 20130036415 A | * | 4/2013 |

OTHER PUBLICATIONS

Translation of KR20130036415A,Ji et al., Microwave oven having hood, Oct. 2013, European Patent Office.*
Korean Intellectual Property Office; Office Action issued in counterpart Korean Application No. 10-2014-0174472; dated Nov. 17, 2015; Korea.

* cited by examiner

*Primary Examiner* — Quang Van

(57) ABSTRACT

An over-the-range microwave oven includes: a housing; a cooking unit which is disposed in the housing; an air discharge unit which includes an air discharge motor in the housing; an air discharge duct unit which discharges air through the air discharge unit; a cooling duct unit which guides outside air to the air discharge motor in order to cool the air discharge motor; and a duct unit in which the air discharge duct unit and the cooling duct unit are separated vertically.

20 Claims, 4 Drawing Sheets

OVER-THE-RANGE MICROWAVE OVEN AND METHOD OF USING THE SAME

CROSS-REFERENCE TO RELATED APPLICATION

This application claims benefit of and priority to Korean Patent Application No. 10-2014-0174472, filed on Dec. 5, 2014, with the Korean Intellectual Property Office, the disclosure of which is incorporated herein in its entirety by reference.

TECHNICAL FIELD

Embodiments according to the present disclosure relate to an over-the-range microwave oven that improves cooling capacity by improving the structure of an upper duct unit, and a method of using the over-the-range microwave oven.

BACKGROUND

In general, an over-the-range microwave oven refers to a microwave oven that discharges air. An over-the-range microwave oven is spaced apart from the upper side of a gas range in order to implement the aforementioned functionality.

A typical over-the-range microwave oven may include a cooking unit and a duct unit. The cooking unit heats substances such as food or liquids (hereinafter, referred to simply as food) using microwave energy. The duct unit is outside the cooking unit and sucks air around the gas range, which is disposed below the over-the-range microwave oven, or outside air into the cooking unit, and discharges air from inside the cooking unit to outside the cooking unit.

An over-the-range microwave oven in the related art is disclosed in Korean Patent No. 10-0538169 (Title of Invention: Wall-Mounted Microwave Oven).

In the related art, air is discharged through an electric equipment chamber, in which most of the drive units are disposed, via an air discharge unit of the duct unit, in order to cool the heat generated by the drive units in the over-the-range microwave oven.

Because the air, which has already cooled the drive units, also cools the air discharge unit in an over-the-range microwave oven in the related art, there is a problem in that the efficiency of cooling the air discharge motor of the air discharge unit is reduced.

In addition, in order to cool the air discharge motor of the air discharge unit, impellers having complicated structures are used in motor cooling units and air discharge units.

In addition, because a separate convection motor is required to create convection, there are problems in that the overall size of the over-range microwave oven and its manufacturing costs are increased.

In summary, there are problems in that the over-the-range microwave oven in the related art has a complicated structure, increased manufacturing costs, and reduced air discharge capacity.

SUMMARY

An example embodiment according to the present disclosure provides an over-the-range microwave oven including: a housing; a cooking unit which is disposed in the housing; an air discharge unit which includes an air discharge motor in the housing; an air discharge duct unit which discharges air through the air discharge unit; a cooling duct unit which guides outside air to the air discharge motor in order to cool the air discharge motor; and a duct unit in which the air discharge duct unit and the cooling duct unit are separated vertically.

In addition, a cooling hole into which the outside air flows may be formed in the front of the housing, the air discharge unit may further include an impeller, the housing may further include a partition housing which partitions the interior of the housing into the cooking unit and the duct unit, the air discharge duct unit may include an upper duct unit which is disposed at an upper side of the partition housing and discharges air flowing from the air discharge unit to the outside, and the cooling duct unit may be formed between the partition housing and the upper duct unit, may communicate with the cooling hole, and may guide the outside air flowing from the outside to flow to the air discharge motor.

In addition, the upper duct unit may include a first plate which is spaced apart from an upper side of the partition housing, a pair of second plates which is disposed to guide air discharged from the air discharge unit toward the front side of the over-the-range microwave oven, and a third plate which is disposed at the rear of the pair of second plates and has an inlet hole into which the air discharged from the air discharge unit flows.

In addition, the third plate may include a first inlet hole and a second inlet hole, and the impeller may include a first impeller which is disposed at one side of the air discharge motor to allow air to flow into the first inlet hole, and a second impeller which is disposed at the other side of the air discharge motor to allow air to flow into the second inlet hole.

In addition, the third plate may further include a bent or angled portion which protrudes forward between the first inlet hole and the second inlet hole.

In addition, a venting hole, which allows air flowing from the cooling duct unit to the air discharge motor to flow to the upper duct unit, may be formed in the angled portion.

In addition, the cooling duct unit may have a pair of partition walls which is formed between the partition housing and the upper duct unit to allow the outside air flowing from the cooling hole to flow to the air discharge motor.

In addition, the air discharge unit may be fixed to a rear surface of the housing and the partition housing, and an outside air hole into which the outside air flows may be formed in the rear surface of the housing and corresponds to a position of the air discharge motor.

In addition, at least two or more outside air holes may be formed in the rear surface of the housing.

In another example embodiment according to the present disclosure, a method of using an over-the-range microwave oven includes: operating an air discharge unit of the over-the-range microwave oven; and cooling an air discharge motor of the air discharge unit by allowing outside air to flow from an outside air hole of a housing which is disposed at the rear of the air discharge motor of the air discharge unit, and from a cooling duct unit which is formed between an upper duct unit for discharging air flowing from the air discharge unit and a partition housing of the housing.

Embodiments according to the present disclosure provide an over-the-range microwave oven which includes the cooling duct unit which is disposed between the upper duct unit and the cooking unit, and the outside air hole formed at the rear of the air discharge motor, thereby cooling the air discharge motor and providing excellent air discharge capacity.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
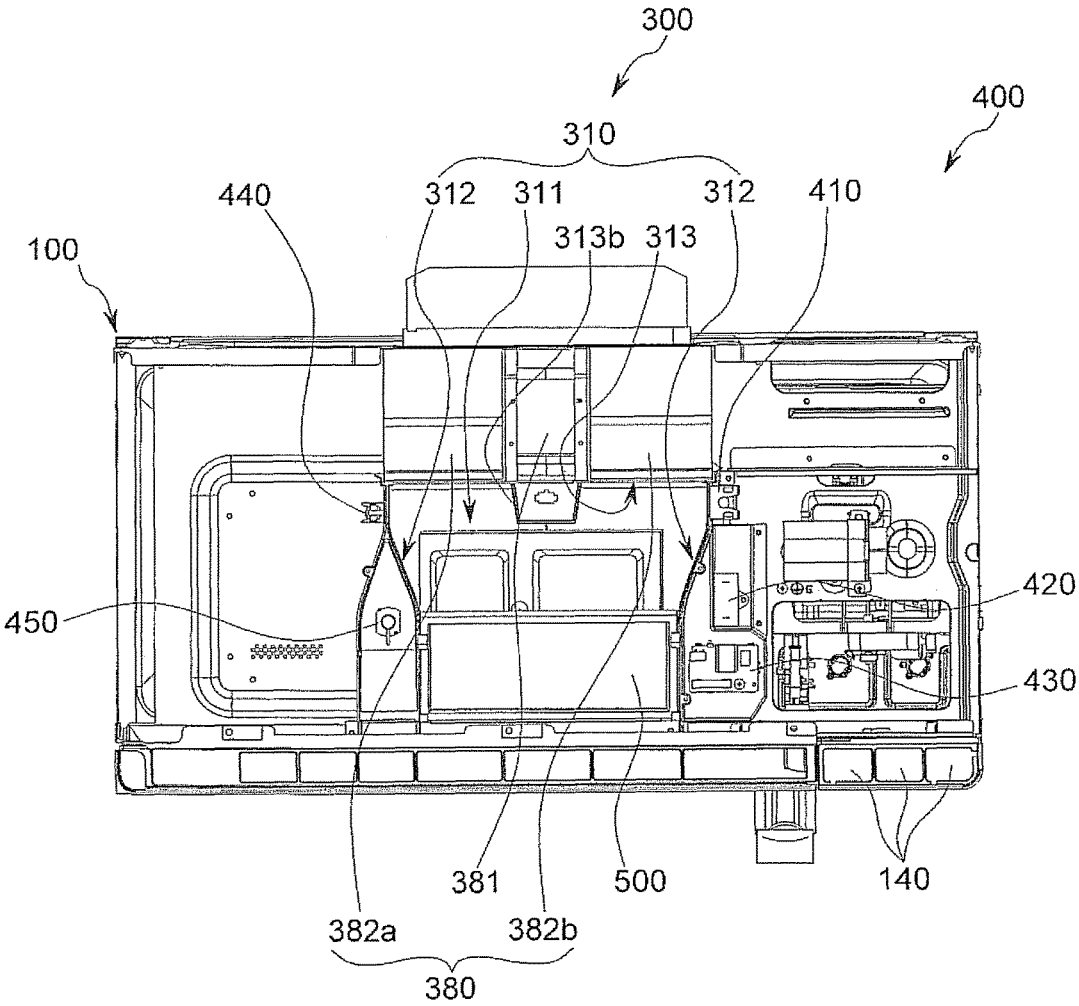
FIG. 1 illustrates an over-the-range microwave oven in an embodiment according to the present disclosure.

In the following detailed description, reference is made to the accompanying drawings. The illustrative embodiments described in the detailed description, drawings, and claims are not meant to be limiting. Other embodiments may be utilized, and other changes may be made, without departing from the spirit or scope of the subject matter presented here.

Hereinafter, an example embodiment according to the present disclosure will be described in detail with reference to the accompanying drawings.

Unless particularly defined otherwise, terms used in the present specification have the same general meanings as they would be understood by those skilled in the art, and if the terms used in the present specification conflict with the general meanings of those terms, then the meanings of the terms comply with the meanings defined in the present specification.

The present disclosure, which is disclosed below, is merely intended to describe example embodiments according to the present disclosure, but is not intended to limit the scope of the present disclosure. Like reference numerals designate like elements throughout the specification.

Figure 2:
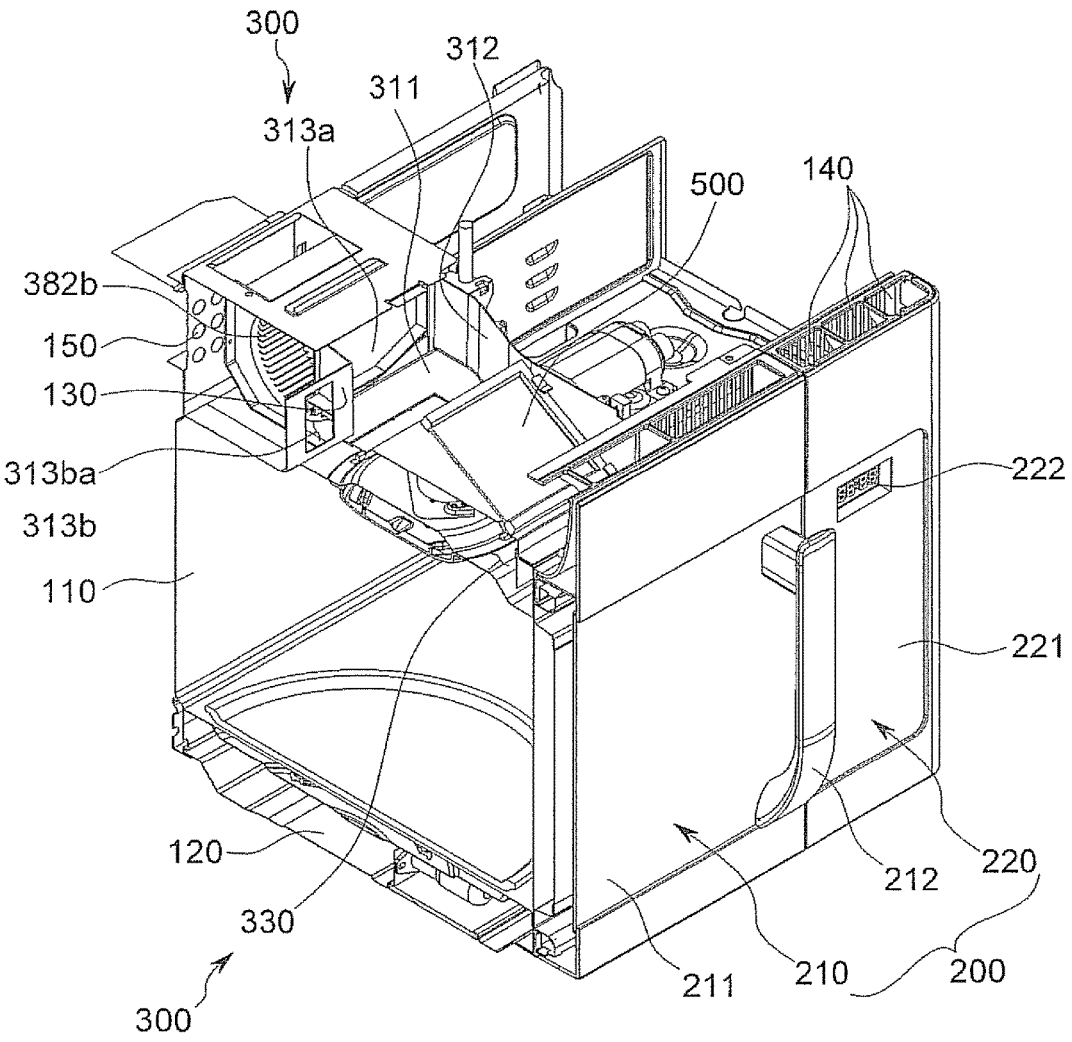
FIG. 2 is a cutaway view of the over-the-range microwave oven of FIG. 1.
Figure 3:
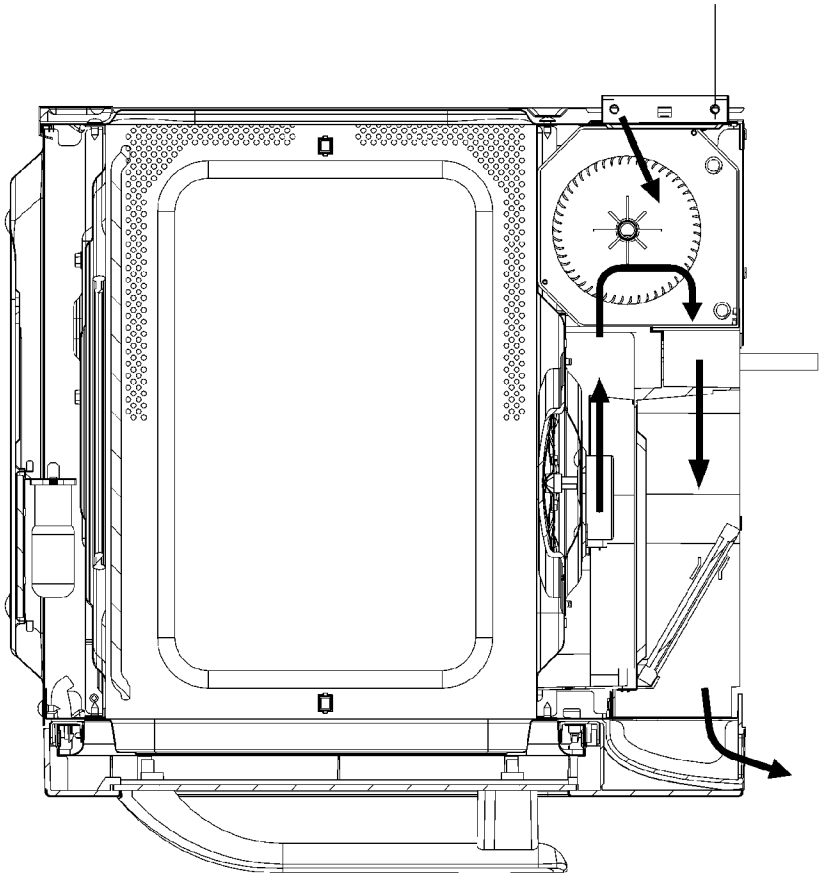
FIG. 3 illustrates a flow of air for cooling an air discharge motor of the over-the-range microwave oven in an embodiment according to the present disclosure.

FIG. 1 is a top-down view illustrating an over-the-range microwave oven in an example embodiment according to the present disclosure in which the upper housing is not shown, FIG. 2 is a cutaway view of the over-the-range microwave oven of FIG. 1, and FIG. 3 is illustrates a flow of air for cooling an air discharge motor of the over-the-range microwave oven in an embodiment according to the present disclosure.

Referring to FIGS. 1 and 2, in an embodiment, an over-the-range microwave oven 400 includes a housing 100, a cooking unit 200, a duct unit 300, and an air discharge unit 380.

The housing 100 defines the external appearance of the over-the-range microwave oven 400, and may be made of a metallic material or a nonmetallic material. The housing 100 may include an upper housing and a lateral side housing, which are not illustrated, and a rear housing 110 and a lower housing 120, which are illustrated in FIG. 2. The respective housings may be integrally formed or may be detachably coupled to each other.

In addition, the housing 100 may further include a vertical partition housing 130, which partitions the interior of the housing 100 into the cooking unit 200 and the duct unit 300. The partition housing 130 may be formed integrally with the housing 100, or it may be fastened to the housing 100 by bolts, for example.

Cooling holes 140 into which outside air flows may be formed in the front of the housing 100, and the cooling holes 140 may communicate with the duct unit 300 which will be described below.

In addition, the housing 100 may be formed as an outer wall of the duct unit 300 which will be described below. Therefore, outside air holes 150 into which outside air flows may be formed in a rear surface of the housing 100, to correspond to the position of an air discharge motor 381 which will be described below. At least two or more outside air holes 150 may be formed.

It is possible to efficiently cool the air discharge motor 381 by the cooling holes 140 and/or the outside air holes 150.

The cooking unit 200 is disposed in the housing 100, and may include a cooking chamber 210 and an electric equipment chamber 220.

A door 211 may be disposed in the front of the cooking chamber 210. The door 211 may be hingedly coupled to the housing 100 so as to be closed and opened toward one side, and a handle 212 may be disposed on the door 211 to allow a user to easily open and close the door 211. In addition, in order to allow the user to easily observe the interior of the cooking chamber 210, the door 211 may further include a transparent window (not illustrated) made of tempered glass which may be disposed in the center of the door 211.

The electric equipment chamber 220 may be provided with a control panel 221 at one side. The control panel 221 may include buttons, a touch panel, or a dial to allow the user to control the cooking unit 200, and may include a display unit 222 to allow the user to view various types of information associated with the over-the-range microwave oven according to an example embodiment.

In addition, the control panel 221 may include buttons, a touch panel, or a dial to allow the user to operate the duct unit 300 which will be described below, and may control a cooking environment in the cooking chamber 210 based on a state of the interior of the cooking chamber 210, which is sensed by a humidity sensor 450.

The duct unit 300 is disposed between the housing 100 and the cooking unit 200 to form a flow path, and may be divided into an upper duct unit 310, a lateral side duct unit, and/or a cooling duct unit 330.

In addition, the duct unit 300 in an example embodiment according to the present disclosure may be divided into an air discharge duct unit and a cooling duct unit which are separated vertically.

The air discharge duct unit serves to discharge sucked air through the air discharge unit 380 which will be described below, and the cooling duct unit serves to guide outside air to the air discharge motor 381 in order to cool the air discharge motor 381.

The lateral side duct unit is formed between the cooking unit 200 and the lateral side housing (not illustrated) or between the control panel 221 and the lateral side housing 100 (not illustrated). In this case, the housing 100 may form an outer wall of the duct unit 300.

The upper duct unit 310 may include a first plate 311, second plates 312, and a third plate 313.

By virtue of the upper duct unit 310, the example embodiment may efficiently form an air discharge flow path from a rear side toward a front side of the over-the-range microwave oven 400, and may be implemented in a hood and an over-the-range microwave oven to reduce the occurrence of turbulent flows, electric power consumption, and noise even though a larger amount of driving power is used.

The first plate 311 is disposed in the housing 100, and may be disposed at an upper side of the cooking unit 200 by being disposed at an upper side of the partition housing 130. In addition, the first plate 311 may be spaced apart from an upper side of the partition housing 130, or a part of the partition housing 130 may be recessed downward, such that the partition housing 130 may be spaced apart from the first plate 311.

The first plate 311 may be made of a metallic material or a nonmetallic (e.g., plastic) material.

Two second plates 312 may be disposed as a pair between the first plate 311 and the housing 100 so as to partition the interior of the upper duct unit 310, and may be disposed to guide air, which is discharged from the air discharge unit 380 which will be described below, to the front side of the over-the-range microwave oven 400.

The flow path, which is symmetrical and becomes narrower toward the front side of the over-the-range microwave oven 400, may greatly improve flow efficiency of the air discharge flow path compared to the related art, and may reduce noise.

The third plate 313 is disposed at the rear of the pair of second plates 312, and may have an inlet hole 313*a* into which air flows. That is, according to the air discharge flow path in the example embodiment, air may pass through a first inlet port formed at the lower side or at the lateral side and through second inlet ports formed in the first plate 311, through impellers 382*a* and 382*b* which will be described below, into the inlet hole 313*a*, and then discharged to the outside through a flow path formed by the first plate 311, the second plates 312, and the upper housing 100, as shown in FIG. 3.

In addition, the third plate 313 may include the first inlet hole 313*a*, which corresponds to the first impeller 382*a* which will be described below, and a second inlet hole (not illustrated), which corresponds to the second impeller 382*b* which will be described below, thereby more effectively implementing air flow.

In addition, the third plate 313 may further include a bent or angled portion 313*b*, which is formed between the first inlet hole 313*a* and the second inlet hole (not illustrated) so as to protrude forward, thereby more efficiently implementing air flow.

In order to efficiently prevent turbulent flow, the angled portion 313*b* may be formed in various shapes that become narrower toward the front side of the over-the-range microwave oven 400. For example, the angled portion 313*b* may be formed in a trapezoidal shape.

In addition, the angled portion 313*b* may have a venting hole 313*ba* formed to allow air, which flows from the duct unit 300 to be described below toward the air discharge motor 381, to flow into the upper duct unit 310. By virtue of the venting hole 313*ba*, it is possible to form a flow path to smoothly cool the air discharge motor 381 which will be described below.

The cooling duct unit 330 is formed between the partition housing 130 and the upper duct unit 310, and may communicate with the cooling hole 140 to guide outside air from the outside of the over-the-range microwave oven 400 to flow to the air discharge motor 381.

Therefore, the cooling duct unit 330 may have a pair of partition walls which is formed between the partition housing 130 and the upper duct unit 310, specifically, between the partition housing 130 and the first plate 311, to allow outside air flowing from the cooling hole 140 to flow to the air discharge motor 381.

By virtue of the cooling duct unit 330, the outside air may pass through the cooling hole 140 at the front side of the housing 100, the duct unit 300, the air discharge motor 381, and the venting hole 313*ba* of the angled portion 313*b*, to the upper duct unit 310, and then finally discharged, as shown in FIG. 3. The aforementioned flow structure has an advantage in that the air discharge motor 381 may be directly cooled.

The air discharge unit 380 may be disposed between the third plate 313 and the rear housing 110 that is a rear side of the housing 100. Specifically, the air discharge unit 380 is fixed to the rear housing 110 and the partition housing 100, and allows air to flow into the inlet hole 313*a*. Specifically, the air discharge unit 380 may include the air discharge motor 381 in the housing 100, and may include the pair of impellers 382*a* and 382*b* which is operated by the air discharge motor 381 and allows air to flow into the inlet hole 313*a*.

In an embodiment, the impellers 382*a* and 382*b* include the first impeller 382*a* which is disposed at one side of the air discharge motor 381, and the second impeller 382*b* which is disposed at the other side of the air discharge motor 381. Both ends of the first impeller 382*a* and the second impeller 382*b* are disposed to correspond to the aforementioned second inlet ports, respectively, thereby allowing air sucked from the outside to flow into a space formed by the housing 100, the first plate 311, and the second plates 312.

In an example embodiment, because the upper duct unit 310 becomes narrower toward the front side of the over-the-range microwave oven 400 as described above, constituent elements for operating the duct unit 300 may be compactly included in the over-the-range microwave oven 400.

In an embodiment, a duct module may include a power source unit 410, a running capacitor 420, a noise filter 430, and a fuse 440, and may further include the humidity sensor 450.

The power source unit 410 is supplied with electric power from an external source, and distributes electric power to operate the cooking unit 200 or the duct unit 300. The power source unit 410 may be disposed on the first plate 311 outside one of its horizontal portions (at the position shown in FIG. 1, for example).

The running capacitor 420 is also called a starting condenser, and may be disposed to provide force for initially operating the air discharge motor 381. The running capacitor 420 may be disposed on the first plate 311 outside one of its inclined portions (at the position shown in FIG. 1, for example).

The noise filter 430 serves to reduce noise components of an alternating current which are generated when the air discharge motor 381 is operated, and serves to pass required signal components. The noise filter 430 may be disposed on the first plate 311 outside one of its horizontal portions (at the position shown in FIG. 1, for example).

The fuse 440 is disposed to shut off electric power, which is distributed from the power source unit 410, when an excessive amount of heat (for example, about 90° C. to 150° C.) is generated in the cooking unit 200, or when overheating of the air discharge motor 381 is sensed. The fuse may be disposed on the first plate 311 outside the other of its horizontal portions (at the position shown in FIG. 1, for example).

The humidity sensor 450 senses the amount of humidity or the temperature of water vapor generated from food being cooked in the cooking unit 200, and may transmit a signal for controlling cooking functions to a control unit (not illustrated) of the cooking unit 200, or may produce a signal for turning on and off the air discharge motor 381.

The humidity sensor 450 serves to sense the amount of humidity of water vapor generated in the cooking unit 200, and may be disposed at an upper side of the cooking unit 200, and the duct module may be disposed on the first plate 311 outside the other inclined portion and the other horizontal portion.

In summary, by allowing the configurations according to the exemplary embodiment to be disposed at the upper side of the cooking unit 200, or by modularizing constituent elements for operating the duct unit 300 so that the constituent elements may be integrated onto the first plate 311, it is possible to reduce assembly tolerances, increase productivity, and reduce the size of the over-the-range microwave oven.

In addition, by improving a structure of the duct unit 300, a state of the cooking unit 200 may be more accurately sensed by the humidity sensor 450.

An embodiment according to the present disclosure may further include a filter unit 500, and the filter unit 500 may be disposed in front of the pair of second plates 312. Specifically, the filter unit 500 may be disposed at a horizontal portion of a second plate (at the position shown in FIG. 1, for example). The filter unit 500 may be implemented as a charcoal filter, may filter air that is discharged to the outside, and may be detachable.

Figure 4:
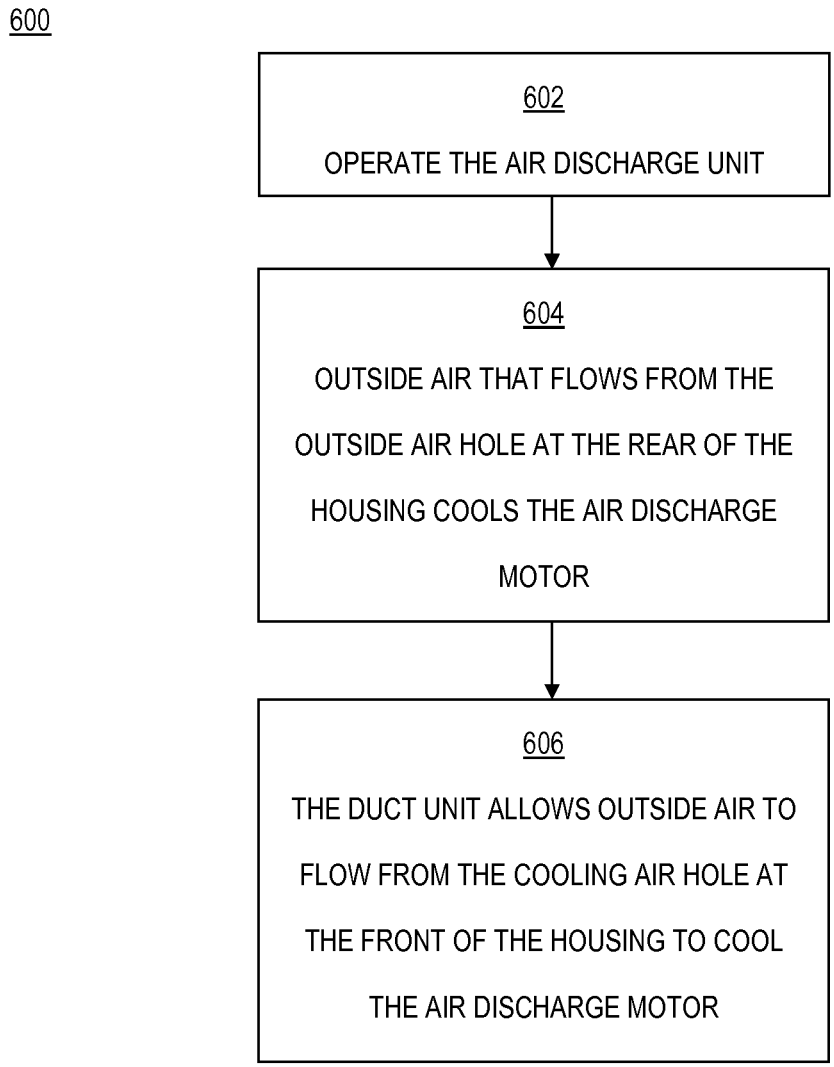
FIG. 4 is a flowchart of a method using an over-the-range microwave oven in an embodiment according to the present disclosure.

With reference to FIG. 4, a method 600 of using the over-the-range microwave oven in an embodiment according to the present disclosure will be described below.

First, the air discharge unit 380 of the over-the-range microwave oven is operated (block 602).

Then, outside air, which flows from the outside air hole 150 of the housing 100 which is disposed at the rear of the air discharge motor 381 of the air discharge unit 380, cools the air discharge motor 381 (block 604). Further, the duct unit 300, which is formed between the upper duct unit 310 for discharging air flowing from the air discharge unit 380 and the partition housing 130 of the housing 100, allows outside air to flow from the cooling hole 140 formed in the front of the housing 100, such that the outside air cools the air discharge motor 381 of the air discharge unit 380 (block 606).

Therefore, according to the present disclosure, a separate cooling motor is not required, and the outside air is supplied directly to the air discharge motor 381 instead of passing through the electric equipment chamber 220 of the cooking unit 200, thereby lowering air temperature and resulting in excellent cooling efficiency, further improving the air discharge capacity of the duct unit 300 provided in the over-the-range microwave oven 400, and improving durability.

From the foregoing, it will be appreciated that various embodiments according to the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. An over-the-range microwave oven comprising:

a housing;

a cooking unit which is disposed in the housing;

an air discharge unit which includes an air discharge motor in the housing;

an air discharge duct unit which discharges air through the air discharge unit;

a cooling duct unit which guides outside air to the air discharge motor in order to cool the air discharge motor; and a duct unit in which the air discharge duct unit and the cooling duct unit are separated vertically, wherein a cooling hole into which the outside air flows is formed in the front of the housing, the air discharge unit further includes an impeller, the housing further includes a partition housing which partitions the interior of the housing into the cooking unit and the duct unit, the air discharge duct unit includes an upper duct unit which is disposed at an upper side of the partition housing and discharges air flowing from the air discharge unit to the outside, and the cooling duct unit is formed between the partition housing and the upper duct unit, communicates with the cooling hole, and guides the outside air flowing from the outside to flow to the air discharge motor, and wherein the air discharge unit is fixed to a rear surface of the housing and the partition housing, and an outside air hole into which the outside air flows is formed in the rear surface of the housing and corresponds to a position of the air discharge motor.

2. The over-the-range microwave oven of claim 1, wherein the upper duct unit includes a first plate which is spaced apart from the upper side of the partition housing, a pair of second plates which is disposed to guide air discharged from the air discharge unit toward the front side of the over-the-range microwave oven, and a third plate which is disposed at the rear of the pair of second plates and has an inlet hole into which the air discharged from the air discharge unit flows.

3. The over-the-range microwave oven of claim 2, wherein the third plate includes a first inlet hole and a second inlet hole, and the impeller includes a first impeller which is disposed at one side of the air discharge motor to allow air to flow into the first inlet hole, and a second impeller which is disposed at the other side of the air discharge motor to allow air to flow into the second inlet hole.

4. The over-the-range microwave oven of claim 3, wherein the third plate further includes an angled portion which protrudes forward between the first inlet hole and the second inlet hole.

5. The over-the-range microwave oven of claim 4, wherein a venting hole, which allows air flowing from the cooling duct unit to the air discharge motor to flow into the upper duct unit, is formed in the angled portion.

6. The over-the-range microwave oven of claim 5, wherein the cooling duct unit comprises a pair of walls between the partition housing and the first plate of the upper duct unit to direct the outside air from the cooling hole through the duct unit to the air discharge motor, then to the venting hole in the angled portion of the third plate of the upper duct unit from where the air is discharged from the over-the-range microwave oven.

7. The over-the-range microwave oven of claim 2, wherein the cooling duct unit comprises a pair of walls between the partition housing and the first plate of the upper duct unit to direct the outside air from the cooling hole through the duct unit to the air discharge motor, then to the upper duct unit from where the air is discharged from the over-the-range microwave oven.

8. The over-the-range microwave oven of claim 1, wherein the cooling duct unit has a pair of partition walls which is formed between the partition housing and the upper duct unit so as to allow the outside air flowing from the cooling hole to flow to the air discharge motor.

9. The over-the-range microwave oven of claim 1, wherein at least two or more outside air holes are formed in the rear surface of the housing.

10. The over-the-range microwave oven of claim 1, wherein outside air from the outside air hole and the cooling hole is supplied directly to the air discharge motor.

11. An over-the-range microwave oven comprising:

a housing which includes a partition that vertically partitions the interior of the housing into a cooking unit and a duct unit, and has a cooling hole, into which outside air flows, at the front side thereof;

an air discharge unit which is fixed to a rear surface of the housing and the partition housing, and includes an air discharge motor, and a pair of impellers which are disposed at opposites sides of the air discharge motor;

an upper duct unit which is disposed at an upper side of the partition housing and discharges air flowing from the air discharge unit to the outside; and a cooling duct unit which is formed between the partition housing and the upper duct unit and is coupled with the cooling hole, and guides the outside air flowing from the outside to the air discharge motor to cool the air discharge motor, wherein an outside air hole into which the outside air flows is formed in the rear surface of the housing and corresponds to a position of the air discharge motor.

12. The over-the-range microwave oven of claim 11, wherein at least two or more outside air holes are formed in the rear surface of the housing.

13. The over-the-range microwave oven of claim 11, wherein the upper duct unit includes a first plate which is spaced apart from an upper side of the partition housing, a pair of second plates which guide air discharged from the air discharge unit toward the front side, and a third plate at the rear of the pair of second plates and has an inlet hole into which the air discharged from the air discharge unit flows.

14. The over-the-range microwave oven of claim 13, wherein the third plate includes a first inlet hole and a second inlet hole, and the impeller includes a first impeller, which is disposed at one side of the air discharge motor so as to allow air to flow into the first inlet hole, and a second impeller, which is disposed at the opposite side of the air discharge motor so as to allow air to flow into the second inlet hole.

15. The over-the-range microwave oven of claim 14, wherein the third plate further includes an angled portion which protrudes forward between the first inlet hole and the second inlet hole.

16. The over-the-range microwave oven of claim 15, wherein a venting hole, which allows air flowing from the cooling duct unit to the air discharge motor to flow into the upper duct unit, is formed in the angled portion.

17. The over-the-range microwave oven of claim 16, wherein the cooling duct unit comprises a pair of walls between the partition housing and the first plate of the upper duct unit to direct the outside air from the cooling hole through the duct unit to the air discharge motor, then to the venting hole in the angled portion of the third plate of the upper duct unit from where the air is discharged from the over-the-range microwave oven.

18. The over-the-range microwave oven of claim 13, wherein the cooling duct unit comprises a pair of walls between the partition housing and the first plate of the upper duct unit to direct the outside air from the cooling hole through the duct unit to the air discharge motor, then to the upper duct unit from where the air is discharged from the over-the-range microwave oven.

19. The over-the-range microwave oven of claim 11, wherein the cooling duct unit has a pair of partition walls which is formed between the partition housing and the upper duct unit to allow the outside air flowing from the cooling hole to flow to the air discharge motor.

20. The over-the-range microwave oven of claim 11, wherein outside air from the outside air hole and the cooling hole is supplied directly to the air discharge motor.

* * * * *